US007764915B2

(12) United States Patent
Uehara et al.

(10) Patent No.: US 7,764,915 B2
(45) Date of Patent: Jul. 27, 2010

(54) ELASTIC ROLL AND FIXING DEVICE

(75) Inventors: Yasuhiro Uehara, Kanagawa (JP); Junpei Amano, Kanagawa (JP); Chikara Ando, Kanagawa (JP); Ryuji Katsuno, Kanagawa (JP); Jun Kimura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/542,469

(22) Filed: Oct. 4, 2006

(65) Prior Publication Data

US 2007/0189819 A1 Aug. 16, 2007

(30) Foreign Application Priority Data

Feb. 13, 2006 (JP) ..... P2006-034872

(51) Int. Cl.

| | |
|---|---|
| ***G03G 15/20*** | (2006.01) |
| ***B21B 27/06*** | (2006.01) |
| ***H05B 3/02*** | (2006.01) |
| ***H05B 1/00*** | (2006.01) |
| ***H05B 3/00*** | (2006.01) |
| ***H05B 11/00*** | (2006.01) |

(52) U.S. Cl. ..... 399/333; 399/329; 219/469; 219/470; 219/471; 219/216

(58) Field of Classification Search ..... 399/329, 399/333; 219/469–471, 216
See application file for complete search history.

(56) References Cited

U.S. PATENT DOCUMENTS

| | | | | | |
|---|---|---|---|---|---|
| 4,606,144 | A | * | 8/1986 | Sasaki et al. | 43/44.98 |
| 4,796,046 | A | * | 1/1989 | Suzuki et al. | 399/331 |
| 5,264,902 | A | * | 11/1993 | Suwa et al. | 399/333 |
| 5,331,385 | A | * | 7/1994 | Ohtsuka et al. | 399/331 |
| 5,420,679 | A | * | 5/1995 | Goto et al. | 399/335 |
| 5,468,531 | A | * | 11/1995 | Kikukawa et al. | 428/36.5 |
| 5,520,600 | A | * | 5/1996 | Fukumoto | 492/56 |
| 5,532,808 | A | * | 7/1996 | Saito et al. | 399/333 |
| 5,546,175 | A | | 8/1996 | Uehara et al. | |
| 5,561,511 | A | * | 10/1996 | Mizunuma et al. | 399/333 |
| 5,614,999 | A | | 3/1997 | Kanesawa et al. | |
| 5,659,869 | A | * | 8/1997 | Ohtsuka et al. | 399/333 |
| 5,669,053 | A | * | 9/1997 | Hashizume et al. | 399/313 |
| 5,722,026 | A | * | 2/1998 | Goto et al. | 399/333 |
| 5,860,051 | A | * | 1/1999 | Goto et al. | 399/329 |
| 6,029,038 | A | | 2/2000 | Uehara et al. | |
| 6,236,829 | B1 | | 5/2001 | Uehara et al. | |
| 6,377,777 | B1 | * | 4/2002 | Kishino et al. | 399/329 |
| 6,505,029 | B2 | | 1/2003 | Ishizaki et al. | |

(Continued)

FOREIGN PATENT DOCUMENTS

| | | | |
|---|---|---|---|
| CN | 1312492 | A | 9/2001 |

(Continued)

*Primary Examiner*—David M Gray
*Assistant Examiner*—Joseph S Wong
(74) *Attorney, Agent, or Firm*—Morgan, Lewis & Bockius LLP

(57) ABSTRACT

An elastic roll is used in a fixing device of an image forming apparatus. The elastic roll includes an elastic layer and a covering layer disposed on an outside of the elastic layer. The covering layer is made of a heat-resistant resin or a metal, which has higher rigidity than a material of the elastic layer.

13 Claims, 4 Drawing Sheets

U.S. PATENT DOCUMENTS

| | | | | |
|---|---|---|---|---|
| 6,583,389 | B2 * | 6/2003 | Murooka et al. | 219/216 |
| 6,816,699 | B1 * | 11/2004 | Katayanagi et al. | 399/333 |
| 6,911,240 | B2 * | 6/2005 | Kondoh | 428/35.9 |
| 7,218,885 | B2 * | 5/2007 | Oishi et al. | 399/333 |
| 2002/0028736 | A1 | 3/2002 | Kishino et al. | |
| 2004/0091279 | A1 * | 5/2004 | Izawa et al. | 399/67 |
| 2004/0120738 | A1 * | 6/2004 | Kanesawa et al. | 399/328 |
| 2005/0185978 | A1 * | 8/2005 | Kemmochi | 399/69 |

FOREIGN PATENT DOCUMENTS

| | | | |
|---|---|---|---|
| CN | 1340746 | A | 3/2002 |
| JP | 56128982 | A * | 10/1981 |
| JP | 59-37580 | | 3/1984 |
| JP | 6-3995 | | 1/1994 |
| JP | 7-205337 | | 8/1995 |
| JP | 8-146806 | | 6/1996 |
| JP | 8-166734 | | 6/1996 |
| JP | 11-184300 | | 7/1999 |
| JP | 2005-173441 | | 6/2005 |

* cited by examiner

ELASTIC ROLL AND FIXING DEVICE

BACKGROUND

1. Technical Field

This invention relates to an elastic roll and more particularly to an elastic roll used in a fixing device.

2. Description of the Related Art

In an image forming apparatus using the electrophotography system, such as a copier and a printer, a photosensitive member formed like a drum is uniformly charged and is controlled based on image information. Then, the photosensitive member is exposed to light for forming an electrostatic latent image thereon. The electrostatic latent image is formed into a visible image (toner image) with toner. Furthermore, the toner image is transferred to a recording paper and is fixed by a fixing device. As a result, an image is formed on the recording paper.

The heating/pressurizing-type fixing devices used in the image forming apparatuses are classified into a 2-roll system and a belt nip system. JP Hei. 8-146806 A (corresponding to U.S. Pat. No. 5,546,175) and JP Hei. 11-184300 A (corresponding to U.S. Pat. Nos. 6,029,038 and 6,236,829) disclose the 2-roll system. In the 2-roll system, paper onto which a toner image is transferred passes through a nip portion formed between a fixing roll and an elastic roll, and the toner image is fused to the paper by heating of the fixing paper and pressurizing of two rolls. JP Hei. 8-166734 A (corresponding to U.S. Pat. No. 5,614,999) and JP 2005-173441 A disclose the belt nip system. In the belt nip system, paper is heated and pressurized in a nip portion between a fixing roll and a pressing belt wound on plural rolls, so as to fix a toner image onto the paper.

Most of all, the 2-roll system fixing device for fusing a toner image onto paper by pressurizing with two rolls is high in thermal efficiency, consumes less power, and can fix an image at high speed as compared with fixing devices adopting any other heating fixing system, for example, a hot air fixing system or an oven fixing system. Therefore, hitherto the 2-roll system fixing device has been generally widely used.

SUMMARY

According to an aspect of the invention, an elastic roll is used in a fixing device of an image forming apparatus. The elastic roll includes an elastic layer and a covering layer disposed on an outside of the elastic layer. The covering layer is made of a heat-resistant resin or a metal, which has higher rigidity than a material of the elastic layer.

BRIEF DESCRIPTION OF THE DRAWINGS

Exemplary embodiments of the invention will be described in detail below with reference to accompanied drawings, wherein.

DETAILED DESCRIPTION

Exemplary embodiments of the invention will be described below. It is to be understood that the invention is not limited to the following exemplary embodiments and that various modifications and changes may be made without departing from the spirit and the scope of the invention. The accompanying drawings are used to describe the exemplary embodiments of the invention and do not show actual sizes of respective components.

Figure 1:
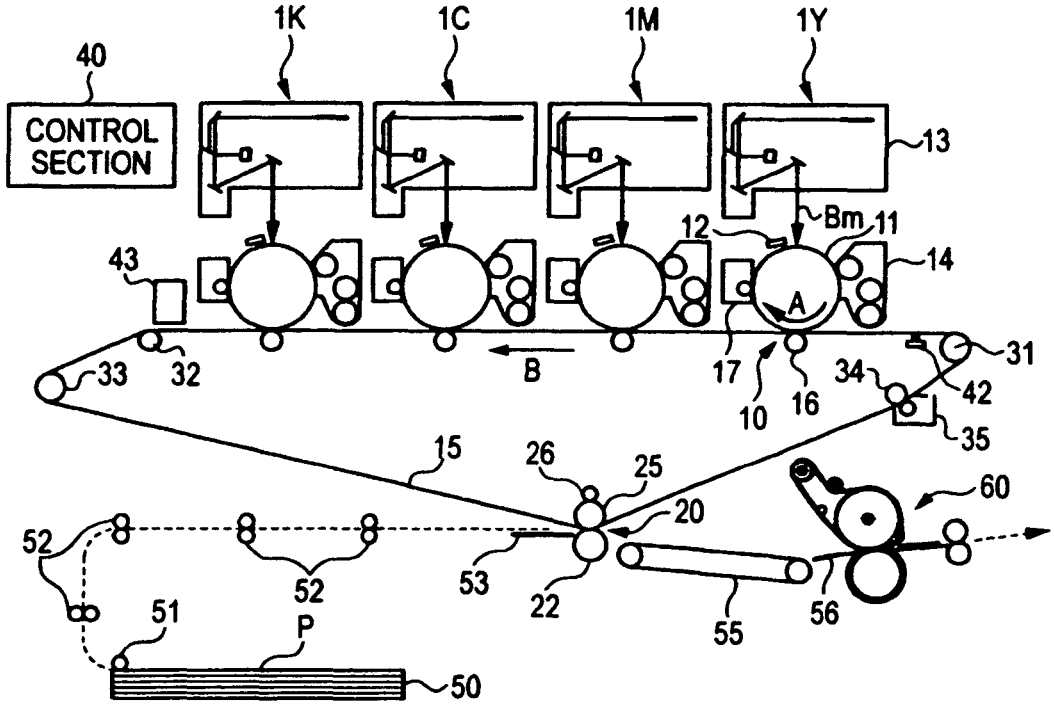
FIG. 1 is a schematic configuration view showing an image forming apparatus incorporating an exemplary embodiment of the invention.

FIG. 1 is a schematic configuration view showing an image forming apparatus according this exemplary embodiment of the invention. The image forming apparatus shown in FIG. 1 is an image forming apparatus adopting an intermediate transfer system generally called as a tandem type. The image forming apparatus includes plural image forming units 1Y, 1M, 1C and 1K, first transfer sections 10, a second transfer section 20, a fixing device 60 and a control section 40. The image forming units 1Y, 1M, 1C, and 1K form toner images of respective color components based on the electrophotography system. The first transfer sections 10 transfer the toner images of the respective color components formed by the image forming units 1Y, 1M, 1C, and 1K to an intermediate transfer belt 15 in order (first transfer). The second transfer section 20 transfers the superposed toner images transferred onto the intermediate transfer belt 15 to paper P, which is a recording material (recording paper; second transfer). The fixing device 60 fixes the second transferred image onto paper P. The control section 40 controls operation of the respective components of the image forming apparatus.

In this exemplary embodiment, each of the image forming units 1Y, 1M, 1C, and 1K includes a photosensitive drum 11, which rotates in an arrow A direction. Disposed in order in the surroundings of each photosensitive drum 11 are electrophotographic devices such as a charger 12, a laser exposure device 13, a developing device 14, a first transfer roll 16 and a drum cleaner 17. The charger 12 charges the photosensitive drum 11. The laser exposure device 13 writes an electrostatic latent image onto the photosensitive drum 11 (in FIG. 1, a reference sign "Bm", indicates an exposure beam). The developing device 14 stores color component toner and visualizes the electrostatic latent image formed on the photosensitive drum 11 with the stored toner. The first transfer roll 16 transfers the toner image of the corresponding color component formed on the photosensitive drum 11 to the intermediate transfer belt 15 in the first transfer section 10. The drum cleaner 17 removes remaining toner on the photosensitive drum 11. The image forming units 1Y, 1M, 1C, and 1K are placed roughly straightly in the order of yellow (Y), magenta (M), cyan (C), and black (K) from the upstream side of the intermediate transfer belt 15.

The intermediate transfer belt 15 serving as an intermediate transfer body may be formed of a film-like endless belt in which a proper amount of an antistatic agent of carbon black is contained in a resin such as polyimide and polyamide. The intermediate transfer belt 15 may have volume resistivity in a range of $10^6$ Ωcm to $10^{14}$ Ωcm and have a thickness of about 0.1 mm. Various rolls circulate the intermediate transfer belt 15 at predetermined speed in a B direction shown in FIG. 1. The various rolls include a drive roll 31, a support roll 32, a tension roll 33, a backup roll 25 and a cleaning backup roll 34. The drive roll 31 is driven by a motor (not shown), which is excellent in a constant speed property, so as to rotate the intermediate transfer belt 15. The support roll 32 supports the intermediate transfer belt 15 with extending roughly straightly along the arrangement direction of the photosensitive member drums 11. The tension roll 33 functions as a correction roll for giving a constant tension to the intermediate transfer belt 15 and preventing the intermediate transfer belt 15 from meandering. The backup roll 25 is provided in the second transfer section 20. The cleaning backup roll 34 is provided in a cleaning section, which scrapes the remaining toner on the intermediate transfer belt 15.

The first transfer section 10 includes the first transfer roll 16, which faces the photosensitive drum 11 with the intermediate transfer belt 15 disposed between the first transfer roll 16 and the photosensitive drum 11. The first transfer roll 16 includes a shaft and a sponge layer serving as an elastic layer fixedly secured to the surroundings of the shaft. The shaft is a columnar bar made of metal such as iron and SUS. The sponge layer is a sponge-like cylindrical roll formed of blend rubber such as NBR, SBR and EPDM blended with a conductive agent of carbon black. The sponge layer has volume resistivity of $10^7$ Ωcm to $10^9$ Ωcm. The first transfer roll 16 is in pressure-contact with the photosensitive drum 11 with the intermediate transfer belt 15 disposed between the first transfer roll 16 and the photosensitive drum 11. Furthermore, a voltage having the opposite polarity (first transfer bias) to the toner charge polarity (which is assumed to be minus) is applied to the first transfer roll 16. Accordingly, the toner images on the photosensitive member drums 11 are electrostatically attracted onto the intermediate transfer belt 15 in order, and the superposed toner images are formed on the intermediate transfer belt 15.

The second transfer section 20 includes a second transfer roll 22 placed on the toner image support side of the intermediate transfer belt 15 and the backup roll 25. The backup roll 25 has a surface formed of a tube of blend rubber of EPDM and NBR with dispersed carbon and the inside made of EPDM rubber. The backup roll 25 has surface resistivity in a range of $10^7$ Ω/□to $10^{10}$ Ω/□ and hardness of 70° (asker C). The backup roll 25 is placed on the back side of the intermediate transfer belt 15 to form an electrode facing the second transfer roll 22. Also, a metal feeding roll 26 to which a second transfer bias is stably applied abuts against the backup roll 25.

On the other hand, the second transfer roll 22 includes a shaft and a sponge layer, which is an elastic layer fixedly secured to the surroundings of the shaft. The shaft may be a columnar bar made of metal such as iron and SUS. The sponge layer may be a sponge-like cylindrical roll formed of blend rubber of NBR, SBR, and EPDM blended with a conductive agent of carbon black. The sponge layer may have volume resistivity in a range of $10^7$ Ωcm to $10^9$ Ωcm. The second transfer roll 22 is in pressure-contact with the backup roll 25 with the intermediate transfer belt 15 disposed between the transfer roll 22 and the backup roll 25. Further, the second transfer roll 22 is grounded, and a second transfer bias is formed between the second transfer roll 22 and the backup roll 25 for second transferring the toner images onto paper P being transported to the second transfer section 20.

An intermediate-transfer-belt cleaner 35 is disposed on the downstream side of the second transfer section 20 of the intermediate transfer belt 15. The intermediate-transfer-belt cleaner 35 removes the remaining toner and paper powder on the intermediate transfer belt 15 and cleans the surface of the intermediate transfer belt 15. The intermediate-transfer-belt cleaner 35 is detachable from the intermediate transfer belt 15. On the other hand, a reference sensor (home position sensor) 42 is disposed on the upstream side of the image forming unit 1Y for yellow. The reference sensor 42 generates a reference signal used as a reference to take timing of image formation for the image forming units 1Y, 1M, 1C, and 1K. An image density sensor 43 for making image quality adjustment is disposed on the downstream side of the image forming unit 1K for black. When the reference sensor 42 recognizes a predetermined mark provided on the back of the intermediate transfer belt 15, the reference sensor 42 generates a reference signal. Each of the image forming units 1Y, 1M, 1C, and 1K starts image formation according to a command, which is output from the control section 40 based on the reference signal.

Further, the image forming apparatus according to this exemplary embodiment includes, as a paper transport system, a paper tray 50, a pickup roll 51, a transport roll 52, a transport chute 53, a transport belt 55 and a fixing entrance guide 56. The paper tray 50 stores paper P. The pickup roll 51 takes out paper P stacked in the paper tray 50 at a predetermined timing and transports the paper P. The transport roll 52 transports the paper P taken out and fed by the pickup roll 51. The transport chute 53 transports the paper P, which has been transported by the transport roll 52, to the second transfer section 20. After the second transfer roll 22 performs the second transfer, the transport belt 55 transports the paper P being transported to the fixing device 60. The fixing entrance guide 56 guides the paper P to the fixing device 60.

Next, the basic image formation process of the image forming apparatus according to this exemplary embodiment will be described. In the image forming apparatus shown in FIG. 1, an image processing apparatus (IPS; not shown) performs predetermined image processing on image data output from an image reader (IIT; not shown) or a personal computer (PC; not shown). Then, the image forming units 1Y, 1M, 1C, and 1K performs image forming operation. The IPS performs the predetermined image processing of various types of image edit, such as shading correction, position shift correction, lightness/color space conversion, gamma correction, frame erasion and color edit, and move edit for input reflection factor data. The image data subjected to the image processing is converted into color material gradation data of four colors of Y, M, C, and K, and the color material gradation data is output to each laser exposure device 13.

Each laser exposure device 13 applies the exposure beam Bm emitted from a semiconductor laser, for example, to the corresponding photosensitive drum 11 of the image forming unit 1Y, 1M, 1C, 1K. the charger 12 charges the surface of the photosensitive drum 11 of each of the image forming units 1Y, 1M, 1C, and 1K. Also, the laser exposure device 13 exposes to the light beam the surface of the photosensitive drum 11 of each of the image forming units 1Y, 1M, 1C, and 1K. Thereby, an electrostatic latent image is formed on the photosensitive drum 11. The developing devices 14 of the image forming units 1Y, 1M, 1C and 1K develop the electrostatic latent images formed on the photosensitive member drums 11 with toners to thereby form Y, M, C, and K color toner images.

The toner image formed on the photosensitive drum 11 of each of the image forming units 1Y, 1M, 1C, and 1K is transferred onto the intermediate transfer belt 15 in the first transfer section 10 where the photosensitive drum 11 and the intermediate transfer belt 15 abut against each other. More specifically, in the first transfer section 10, a voltage (first transfer bias) of the opposite polarity (plus polarity) to the toner charge polarity is applied to the base material of the intermediate transfer belt 15 by the first transfer roll 16, and the toner images are superposed on each other in order on the surface of the intermediate transfer belt 15 for executing first transfer.

After the toner images are first transferred onto the surface of the intermediate transfer belt 15 in order, the intermediate transfer belt 15 moves so as to transport the toner images to the second transfer section 20. When the toner images are transported to the second transfer section 20, in the paper transport system, the pickup roll 51 rotates at the timing at which the toner images are transported to the second transfer section 20 and paper P of a predetermined size is fed from the paper tray 50. The transport roll 52 transports the paper P fed by the pickup roll 51. Then, the paper P arrives at the second transfer section 20 through the chute roll 53. Before arriving at the second transfer section 20, the paper P is once stopped and a registration roll (not shown) rotates at a move timing of the intermediate transfer belt 15 on which the toner images are carried, to thereby adjust a position of the paper P and a position of the toner images.

In the second transfer section 20, the second transfer roll 22 is in pressure-contact with the backup roll 25 via the intermediate transfer belt 15. At this time, the paper P transported at a proper timing is put between the intermediate transfer belt 15 and the second transfer roll 22. At this time, if a voltage (second transfer bias) having the same polarity (minus polarity) as the toner charge polarity is applied from the feeding roll 26, a transfer electric field is formed between the second transfer roll 22 and the backup roll 25. Unfixed toner images carried on the intermediate transfer belt 15 are electrostatically transferred onto the paper P in the second transfer section 20 in which the paper P is pressed by the second transfer roll 22 and the backup roll 25.

Then, the paper P onto which the toner images are electrostatically transferred is transported in a state where the paper is peeled off from the intermediate transfer belt 15 by the second transfer roll 22. The paper P is transported to the transport belt 55, which is disposed on the downstream side of the second transfer roll 22 in the paper transport direction. The transport belt 55 transports the paper P to the fixing device 60 at the optimum transport speed matching the transport speed in the fixing device 60. The unfixed toner images on the paper P transported to the fixing device 60 are subjected to fixing processing of heat and pressure by the fixing device 60 and are fixed onto the paper P. The paper P formed with the fixed image is transported to an ejected paper stack section (not shown) provided in an ejection section of the image forming apparatus.

On the other hand, after completion of the transfer to the paper P, the remaining toner on the intermediate transfer belt 15 is transported with rotation of the intermediate transfer belt 15 and is removed from the top of the intermediate transfer belt 15 by the cleaning backup roll 34 and the intermediate-transfer-belt cleaner 35.

Next, the fixing device 60 used in the image forming apparatus according to this exemplary embodiment will be described.

Figure 2:
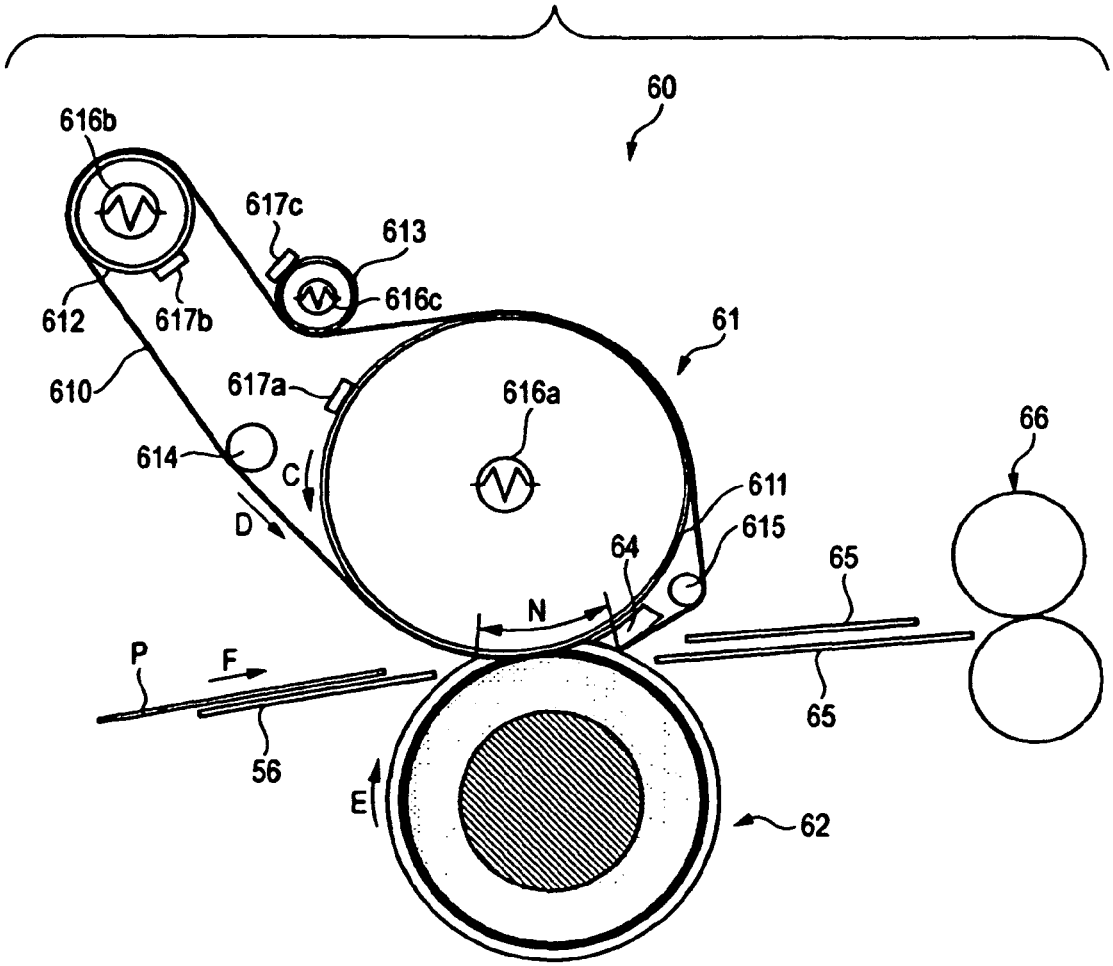
FIG. 2 is a sectional side view showing the schematic configuration of a fixing device according the exemplary embodiment of the invention.

FIG. 2 is a sectional view showing the schematic configuration of the fixing device 60 according to this exemplary embodiment. The fixing device 60 mainly includes a fixing belt module 61 and an elastic roll 62. The fixing belt module 61 serves as a heating member and a pressed member. The elastic roll 62 is an example of a pressing rotation body and is in pressure-contact with the fixing belt module 61.

The fixing belt module 61 mainly includes a fixing belt 610, a fixing roll 611, a tension roll 612, a tension roll 613, a attitude correction roll 614 and a tension roll 615. The fixing roll 611 rotates with the fixing belt 610 placed thereon. The tension roll 612 gives a tension force to the fixing belt 610 from the inside. The tension roll 613 gives a tension force to the fixing belt 610 from the outside. The attitude correction roll 614 corrects the attitude of the fixing belt 610 between the fixing roll 611 and the tension roll 612. The peel pad 64 is an example of a peel member placed on a downstream area in a nip portion N where the fixing belt module 61 and the elastic roll 62 are in pressure-contact with each other and in the vicinity of the fixing roll 611. The tension roll 615 give a tension force to the fixing belt 610, in the downstream side of the nip portion N.

The fixing belt 610 is a flexible endless belt having a predetermined peripheral length and width. The fixing belt usually is of a multilayer structure including a base layer, an elastic layer and a release layer. The base layer is made of a polyimide resin having about 80 μm in thickness. The elastic layer is made of silicone rubber having about 200 μm in thickness and deposited on the surface (outer peripheral surface) of the base layer. The release layer is made of a tetrafluoroethylene-perfluoro-alkyl vinyl ether copolymer resin (PFA) tube having about 30 μm in thickness and formed on the elastic layer. Here, the elastic layer is provided particularly for improving the image quality of a color image. The structure of the fixing belt 610, that is, its material, thickness and hardness may be selected appropriately in accordance with design of the image forming apparatus, a use purpose and a use condition The fixing roll 611 is a cylindrical roll made of aluminum having a predetermined outer diameter, length and thickness. The fixing roll 611 receives a drive force from a drive motor (not shown) and usually rotates in an arrow C direction at about 300 mm/ses in surface speed. The fixing belt 610 moves in an arrow D direction with rotation of the fixing roll 611.

The fixing roll 611 contains thereinside a halogen heater 616*a* rated as 900 W, for example, as a heating source. The control section 40 of the image forming apparatus 1 (see FIG. 1) usually controls the surface temperature of the fixing roll 611 at about 150° C., based on the measurement value of a temperature sensor 617*a*, which is in contact with the surface of the fixing roll 611. The paper P introduced into the fixing device 60 in an arrow F direction from the fixing entrance guide 56. The paper P formed with the fixed image is transported through a paper discharge guide 65 to a paper discharge roll 66.

The tension roll 612 is a cylindrical roll made of aluminum having a predetermined outer diameter, thickness and length. The tension roll 612 contains thereinside a halogen heater 616*b* rated as 1000 W, for example, as a heating source. A temperature sensor 617*b* and the control section 40 (see FIG. 1) control the surface temperature of the tension roll 612 at 190° C. Therefore, the tension roll 612 has a function of heating the fixing belt 610 as well as the function of giving the tension force to the fixing belt 610.

A spring member (not shown) for pressing the fixing belt 610 outwardly is disposed at both ends of the tension roll 612 for usually setting the whole tension of the fixing belt 610 to about 15 kgf. At this time, to uniform the tension of the fixing belt 610 over the width direction and minimize axial displacement of the fixing belt 610 as much as possible, the tension roll 612 is formed into a crown shape in which the outer diameter of its center is larger by 100 μm than that of its ends.

The tension roll 613 is a cylindrical roll made of aluminum having a predetermined outer diameter, thickness and length. A surface of the tension roll 613 is coated with PFA having about 20 μm in thickness to form a release layer. The release layer is formed to prevent slight offset toner and paper powder, which come from the outer peripheral surface of the fixing belt 610, from being deposited on the tension roll 613. Like the tension roll 612, the tension roll 613 is formed into the crown shape in which the outer diameter of its center is made larger by 100 μm than that of its ends. Both or either of the tension roll 612 and the tension roll 613 may be formed into the crown shape.

The tension roll 613 contains thereinside a halogen heater 616*c* rated as about 1000 W, for example, as a heating source. A temperature sensor 617*c* and the control section 40 (see FIG. 1) control the surface temperature of the tension roll 613 at about 190° C. Therefore, the tension roll 613 has a function of heating the fixing belt 610 from the outer surface as well as the function of giving a tension force to the fixing belt 610. Therefore, in this exemplary embodiment, the fixing roll 611, the tension roll 612 and the tension roll 613 heat the fixing belt 610.

The attitude correction roll 614 is a columnar roll made of aluminum having a predetermined outer diameter and length. A belt-edge-position detection mechanism (not shown) for detecting the edge position of the fixing belt 610 is disposed in the vicinity of the attitude correction roll 614. The attitude correction roll 614 includes an axis displacement mechanism for displacing an abutment position in the axial direction where the fixing belt 610 abuts against the attitude correction roll 614, in accordance with the detection result of the belt-edge-position detection mechanism. Thereby, the attitude correction roll 614 controls meandering of the fixing belt 610 (belt walk).

The peel pad 64 is a block member, which has a circular arc in cross section. The peel pad 64 is formed of a rigid body of metal such as SUS or a resin. The peel pad 64 is fixedly disposed over all axial area of the fixing roll 611 on the downstream side of and in the vicinity of an area where the elastic roll 62 is in pressure-contact with the fixing roll 611 through the fixing belt 610. The peel pad 64 is provided so as to press the elastic roll 62 through the fixing belt 610 uniformly with a predetermined load (for example, 10 kgf in average) over a predetermined width area (for example, a width of 2 mm along the traveling direction of the fixing belt 610).

The tension roll 615 is a columnar roll made of aluminum having a predetermined outer diameter and length. The tension roll 611 is disposed in the vicinity of the peel pad 64 and on the downstream side of the peel pad 64 in the traveling direction of the fixing belt 610 so that the fixing belt 610 passing through the peel pad 64 smoothly turns toward the fixing roll 611.

Next, the elastic roll 62 will be described.

Figure 3A:
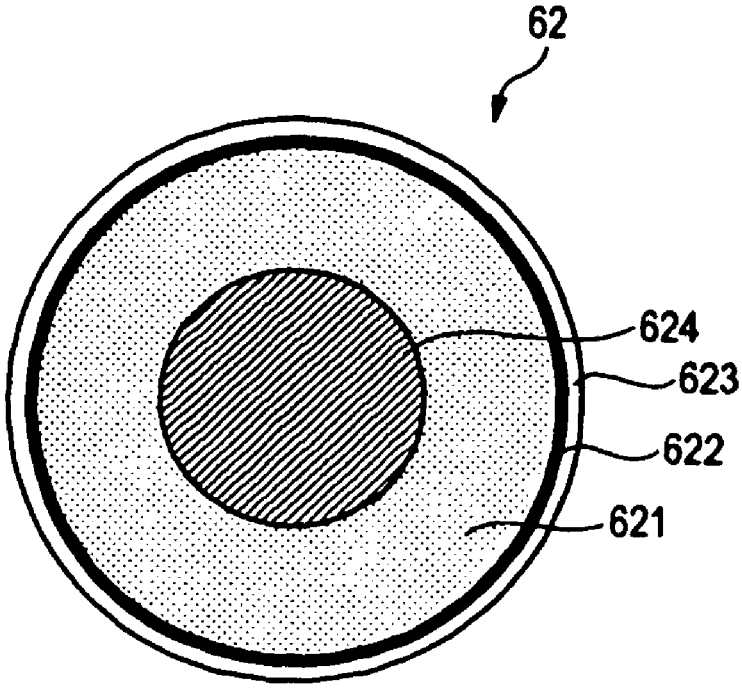
FIG. 3 is a drawing showing the structure of an elastic roll.

FIG. 3 is a view showing the structure of the elastic roll 62. As shown in FIG. 3A, the elastic roll 62 has a metal core 624, an elastic layer 621, a strain prevention layer 622 and a release layer 623. The metal core 624 is made of steel or aluminum and serves as a base body. The elastic layer 621 is made of sponge-like porous silicone rubber. The strain prevention layer 622 is made of a heat-resistant resin or metal, which has higher rigidity than the material of the elastic layer 621. The release layer 623 is made of a PFA tube having a predetermined film thickness. The elastic layer 621, the strain prevention layer 622 and the release layer 623 are deposited in order from the base body side. The elastic roll 62 is disposed so as to be in pressure-contact with the fixing belt module 61. When the fixing roll 611 of the fixing belt module 61 rotates in the arrow C direction (FIG. 2), the elastic roll 62 is driven by the fixing roll 611 and rotates in the arrow E direction (FIG. 2). The traveling speed of the elastic roll 62 is equal to the surface speed of the fixing roll 611.

The elastic roll 62 is provided with the strain prevention layer 622, which is made of the material having higher rigidity than that of the elastic layer 621, at the surface of the elastic roll 62 or in the vicinity of the surface of the elastic roll 62. That is, the strain prevention layer 622 is provided on the outside of the elastic layer 621.

The strain prevention layer 622 is made of a material having higher rigidity than the material of the elastic layer 621. Specifically, examples of the material of the elastic layer 621 include an organic material containing a heat-resistant resin such as polyimide (having modulus of elongation in a range of 300 kg/mm$^2$ to 900 kg/mm$^2$), polyamideimide (having modulus of elongation in a range of 100 kg/mm$^2$ to 300 kg/mm$^2$); a metal material such as a stainless steel film (having about 21,000 kg/mm$^2$ in modulus of elongation); and an inorganic material such as a glass fiber film (having modulus of elongation in a range of 100 kg/mm$^2$ to 1,000 kg/mm$^2$).

The strain prevention layer 622 may be a thin film having such a thickness that formation of the nip portion N is not hindered. Specifically, the thickness of the strain prevention layer 622 may be in a range of about 10 μm to about 200 μm.

In the case of forming the strain prevention layer 622 using any of the materials mentioned above, the thickness of the strain prevention layer 622 may be in a range of about 10 μm to about 150 μm when the organic material is used; may be in a range of about 5 μm to about 50 μm when the metal material is used; may be in a range of about 100 μm to about 200 μm when the inorganic material is used.

The elastic roll 62 incorporating the exemplary embodiment is usually formed with the release layer 623, which is made of a fluorocarbon resin and serves as the surface layer of the elastic roll 62. The release layer 623 may be formed of a fluorocarbon resin tube or a fluorocarbon resin coating material. Most of all, from the viewpoints of mold workability and abrasion resistance of the elastic roll 62, the surface of the elastic roll 62 may be covered with a fluorocarbon resin tube, which is previously molded into a tube shape.

For example, a tube of polytetrafluoroethylene resin (PTFE), tetrafluoroethylene-perfluoro-alkyl vinyl ether copolymer resin (PFA), fluorinated ethylene propylene copolymer resin (FEP), polyvinylidene fluoride resin (PVDF) or polyvinyl fluoride resin may be used as the fluorocarbon resin tube.

When a fluorocarbon resin coating material is used, for example, latex of polytetrafluoroethylene resin (PTFE) may be deposited on the outer peripheral surface of the elastic layer 621.

The thickness of the release layer 623 may be in a range of about 20 μm to about 40 μm. If the release layer 623 is excessively thin, the durability of the elastic roll 62 tends to be degraded.

Figure 3B:
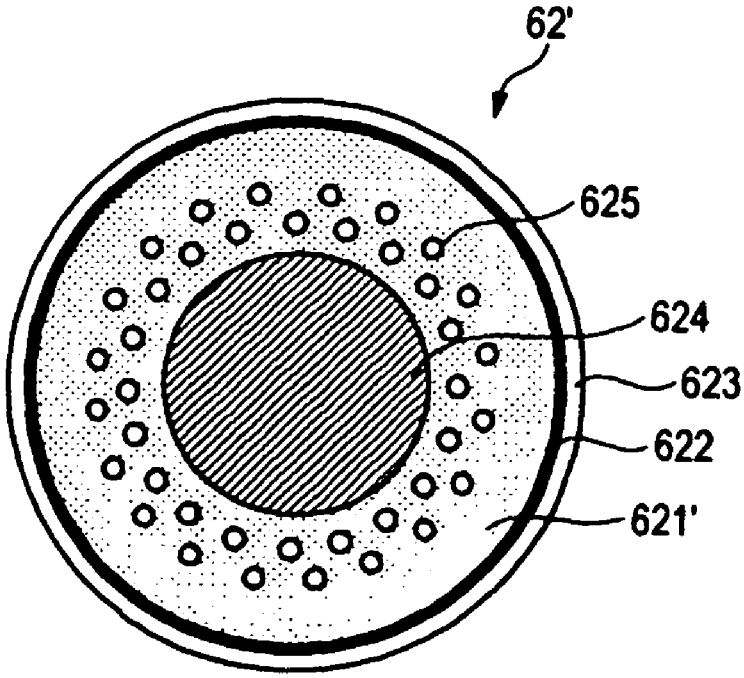

Next, another embodiment of the elastic roll will be described. FIG. 3B is a view showing another embodiment of the elastic roll. As shown in FIG. 3B, an elastic roll 62' has a metal core 624, an elastic layer 621' made of a solid rubber layer and a release layer 623. The metal core 624, the elastic layer 621' and the release layer 623 are deposited in order. The elastic layer 621' is formed with plural through holes 625, which pass through the elastic roll 621' in the longitudinal direction of the elastic roll 621'.

That is, in the case where the rigidity of the strain prevention layer 622 increases, if the fixing belt module 61 is in pressure-contact with the elastic roll 62 with the same load, a nip width of the nip portion N tends to decrease. Then, the through holes 625 are formed in the elastic layer 621'.

As shown in FIG. 3B, the through holes 625 are arranged on two concentric circles in the cross section of the elastic layer 621'. The diameter of each through hole 625 is about 1 mm. The through holes 625 may be arranged with space in a range of about 2 mm to 3 mm therebetween and arranged so as to locate at vertexes of regular triangles.

EXAMPLE

The exemplary embodiment will be described below in more detail based on an example. The exemplary embodiment is not limited to the following example.

(1) 2-Roll System Fixing Device

Figure 4:
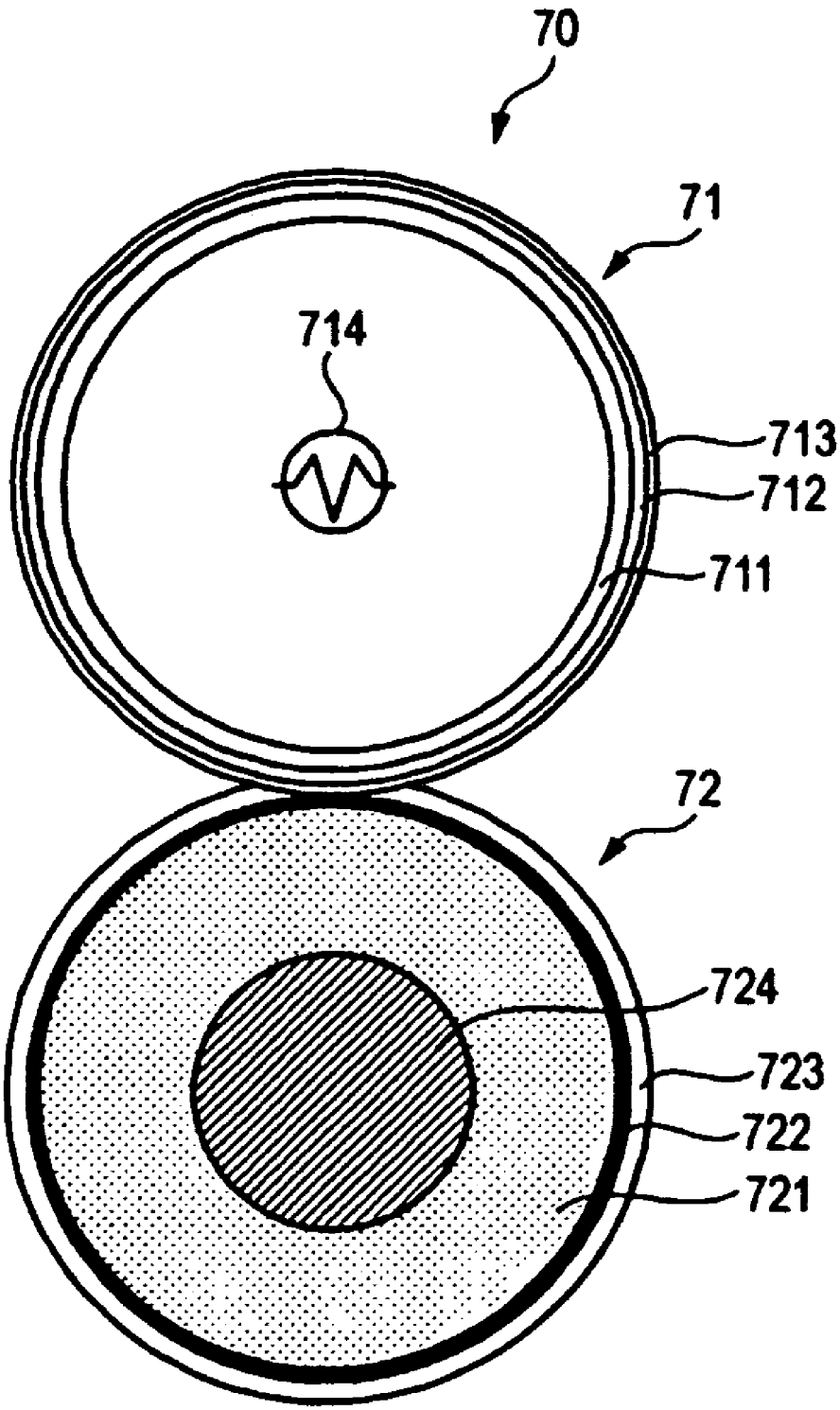
FIG. 4 is a drawing showing a 2-roll system fixing device.

An elastic roll prepared by performing predetermined operation is evaluated using a 2-roll system fixing device 70 shown in FIG. 4.

FIG. 4 is a view showing the 2-roll system fixing device 70. The fixing device 70 includes a fixing roll 71 and an elastic roll 72. The fixing roll 71 serves as a heating member and as a pressed member. The fixing roll 71 includes a cylindrical cored bar 711, a heat-resistant elastic layer 712 deposited on the cored bar 711, and a release layer 713 deposited on the outer peripheral surface of the elastic layer 712. The cored bar 711 contains a heating source 714 made of a halogen heater. The elastic roll 72 is a pressing rotation body serving as a pressed member and is in pressure-contact with the fixing roll 71. The elastic roll 72 includes a metal core 724 made of steel, an elastic layer 721, a strain prevention layer 722 and a release layer 723. The elastic layer 721 is deposited on the metal core 724. The strain prevention layer 722 and the release layer 723 are deposited on the outer peripheral surface of the elastic layer 721.

The diameter of the elastic roll 72 having the strain prevention layer 722 is 50 mm. The metal core 724 (ϕ34 mm) is covered with a silicone sponge (asker C hardness of 65 degrees) having 8 mm in thickness, which is the elastic layer 721. The strain prevention layer 722 made of a polyimide belt having 80 μm in thickness is provided on the outside of the elastic layer 721. Further, the surface of the strain prevention layer 722 is coated with the release layer 723, which is a PFA resin having 30 μm in thickness.

For purposes of comparison, an elastic roll having a similar structure to the elastic roll 72 except that the strain prevention layer 722 is not provided is prepared. The elastic roll of the comparative example is also evaluated using the 2-roll system fixing device 70.

(2) Fixing Test

The elastic roll 72 is pressurized and brought into contact with the fixing roll 71 with the surface temperature pf the fixing roll 71 controlled at 200° C., so as to form a nip portion N having a fixing nip width of 13 mm. Next, normal paper (having basis weight of 60 gsm) having a back surface onto which a fully solid toner image is previously fixed is passed through the nip portion N at fixing speed of 130 mm/s. Then, when the surface temperature of the elastic roll 72 is equal to or higher than 70° C., the normal paper winds around the surface of the elastic roll 72 with the toner on the back of the normal paper fused is observed.

A similar fixing test is also conducted on the elastic roll of the comparative example having no strain prevention layer 722.

EXAMPLE AND COMPARATIVE EXAMPLE

As described above, when the normal paper having the back on which the fully solid toner image is previously fixed is passed through the 2-roll system fixing device 70, which includes the elastic roll 72 having the strain prevention layer 722 and the normal paper winding around the elastic roll 72 is observed, neither a corrugation phenomenon nor paper stretch occurs on the normal paper.

From this result, it can be seen that even if the elastic roll 72 is in close contact with the fixing roll 71, the elastic roll 72 having the strain prevention layer 722 can suppress strain or deformation of paper because strain hardly occurs on the surface of the elastic roll 72.

In contrast, in the case where the elastic roll of the comparative example having no strain prevention layer 722 is used, the normal paper winding around the elastic roll 72 of the comparative example has both of stretch portion and no stretch portion. The corrugation phenomenon occurs on the whole paper. The possible reason why the corrugation phenomenon occurs on the normal paper when the elastic roll of the comparative example having no strain prevention layer 722 is that if toner starts to fuse and paper is brought into close contract with the elastic roll, the paper is affected by the strain on the surface of the elastic roll and becomes deformed likewise. Particularly, for thin paper having low rigidity, paper stretch and corrugation easily occur.

As described above, according to the elastic roll 72 of the example to which the exemplary embodiment is applied, the strain prevention layer 722 is provided on the outside of the elastic layer 721. This structure can reduce a tensile strain on the surface of the elastic roll 72 due to deformation (dent) of the elastic roll 72.

What is claimed is:

1. An elastic roll used in a fixing device of an image forming apparatus, the elastic roll comprising:

an elastic layer;

a covering layer disposed on an outside of the elastic layer, the covering layer being made of a material selected from a group consisting of polyimide and polyamideimide, the material of the covering layer having higher rigidity than a material of the elastic layer;

wherein the elastic layer is formed of a sponge silicon rubber; and a release layer made of a fluorocarbon resin, the release layer disposed on an outside of the covering layer.

2. The elastic roll according to claim 1, wherein:

the elastic layer defines a plurality of through holes, which pass through the elastic layer in an axial direction of the elastic layer, and the through holes are arranged at predetermined intervals.

3. The elastic roll according to claim 1, wherein the covering layer is made of a heat-resistant resin, which has a modulus of elongation in a range of 100 kg/mm$^2$ to 21,000 kg/mm$^2$.

4. The elastic roll according to of claim 1, wherein the covering layer has a thickness in a range of 5 μm to 200 μm.

5. An elastic roll used in a fixing device of an image forming apparatus, the elastic roll comprising:

an elastic layer;

a covering layer formed on the elastic layer, the covering layer having a thickness in a range of 10 μm to 150 μm and being made of a polyimide belt layer or a polyamideimide belt layer;

wherein the elastic layer is formed of a sponge silicon rubber; and a release layer made of a fluorocarbon resin, the release layer disposed on an outside of the covering layer.

6. An elastic roll comprising:

a metal core;

an elastic layer disposed in surroundings of the metal core;

a covering layer disposed on an outside of the elastic layer, the covering layer made of a material selected from a group consisting of polyimide and polyamideimide, the material of the covering layer having higher rigidity than a material of the elastic layer;

wherein the elastic layer is formed of a sponge silicon rubber; and a release layer made of a fluorocarbon resin, the release layer disposed on an outside of the covering layer.

7. An elastic roll comprising:

a metal core;

an elastic layer disposed in surroundings of the metal core;

a covering layer disposed on an outside of the elastic layer, the covering layer having a thickness in a range of 10 μm to 150 μm and being made of a polyimide belt layer or a polyamideimide belt layer;

wherein the elastic layer is formed of a sponge silicon rubber; and a release layer made of a fluorocarbon resin, the release layer disposed on an outside of the covering layer.

8. A heating/pressurizing-type fixing device comprising:

a pressed member; and a pressing rotation body that is in pressure-contact with the pressed member to form a nip portion between the pressed member and the pressing rotation body, the nip portion through which a recording material passes, wherein:

the pressing rotation body comprises:

an elastic layer that is deformed when the pressing rotation body is in pressure-contact with the pressed member;

a covering layer disposed on an outside of the elastic layer, the covering layer made of a material selected from a group consisting of polyimide and polyamideimide, the material of the covering layer having higher rigidity than a material of the elastic layer;

wherein the elastic layer is formed of a sponge silicon rubber; and a release layer made of a fluorocarbon resin, the release layer disposed on an outside of the covering layer.

9. The fixing device according to claim 8, wherein:

the elastic layer defines a plurality of through holes, which pass through the elastic layer in an axial direction of the elastic layer, and the through holes are arranged at predetermined intervals.

10. The fixing device according to claim 8, wherein the covering layer is made of a heat-resistant resin, which has a modulus of elongation in a range of 100 $kg/mm^2$ to 21,000 $kg/mm^2$.

11. The fixing device according to claim 8, wherein the covering layer has a thickness in a range of 5 μm to 200 μm.

12. A heating/pressurizing-type fixing device comprising:

a pressed member; and a pressing rotation body that is in pressure-contact with the pressed member to form a nip portion between the pressed member and the pressing rotation body, the nip portion through which a recording material passes, wherein:

the pressing rotation body comprises:

an elastic layer;

a covering layer disposed on an outside of the elastic layer, the covering layer having a thickness in a range of 10 μm to 150 μm and being made of a polyimide belt layer or a polyamideimide belt layer;

wherein the elastic layer is formed of a sponge silicon rubber; and a release layer made of a fluorocarbon resin, the release layer disposed on an outside of the covering layer.

13. An elastic roll used in a fixing device of an image forming apparatus, the elastic roll comprising:

an elastic layer; and means for reducing strain caused on a surface of the elastic roll by deformation of the elastic layer wherein the means for reducing strain is made of a polyimide belt layer or a polyamideimide belt layer;

wherein the elastic layer is formed of a sponge silicon rubber; and a release layer made of a fluorocarbon resin, the release layer disposed on an outside of the belt layer.

* * * * *